United States Patent [19]

Hennon

[11] 4,443,312

[45] Apr. 17, 1984

[54] SITU METHOD OF COATING BURIED CONDUCTIVE STRUCTURES

[75] Inventor: Gary J. Hennon, Kansas City, Mo.

[73] Assignee: Midwest Research Institute, Kansas City, Mo.

[21] Appl. No.: 418,062

[22] Filed: Sep. 14, 1982

[51] Int. Cl.[3] ..... C25D 13/14

[52] U.S. Cl. ..... 204/181 R; 118/DIG. 11

[58] Field of Search ..... 204/181 R, 181 C; 118/DIG. 11, DIG. 12

[56] References Cited

U.S. PATENT DOCUMENTS

| | | | |
|---|---|---|---|
| 3,199,585 | 3/1963 | Cronberger | 204/181 R |
| 3,978,015 | 8/1976 | Kolish et al. | 524/512 |
| 4,064,028 | 12/1977 | Miyosawa et al. | 204/181 R |

*Primary Examiner*—John F. Niebling
*Assistant Examiner*—B. J. Boggs, Jr.
*Attorney, Agent, or Firm*—Schmidt, Johnson, Hovey & Williams

[57] ABSTRACT

A method is disclosed for the in situ coating of electrically conductive structures such as a pipe line wherein a reservoir of a water dispersion of an ionic organic resin composition is provided at the section of the pipe or other structure to be coated and a direct current is impressed on the reservoir of resin and the conductive structure of a polarity to cause the resin ions to electrophoretically migrate to the conductive surface of the structure and form an insoluble coating thereon. The process allows coating of areas of the structure beyond the limits initially contacted by the resin composition by virtue of the fact that gas evolved from the water during electrolysis progressively displaces soil surrounding the structure allowing the resin to contact additional conductive surface portions of the structure and thus form a coating thereon.

10 Claims, 3 Drawing Figures

SITU METHOD OF COATING BURIED CONDUCTIVE STRUCTURES

This invention relates to a process for in situ coating of conductive structures buried in the ground and is especially useful for coating bare or conductive surface portions of previously protective coated underground structures such as fluid transporting pipes or utility service conduits, support members or the portions of metal storage vessels below ground level.

BACKGROUND OF THE INVENTION

The control of corrosion of metal structures below ground level has long been and continues to be a problem which plagues utility service companies in all geographical areas. The problem is particularly acute in connection with underground pipe lines which frequently are buried in relatively inaccessible locations both urban areas as well as rural geographical sties. In the case of gas transmission pipe lines for example, it is absolutely essential that the pipe be protected to mitigate corrosion, and costs associated with such protection have been significant in the past and are progressively increasing as the length of time the pipe has been buried increases. If corrosion "hot spots" develop along the pipe line, remedial action adds additional cost to the operation, especially if the only alternative is to replace the pipe which has become corroded.

The two most common methods of protecting pipe are coatings and cathodic protection. Usually the two are used in combination. Pipe lines are normally coated to insulate the pipe from the corrosive action of the soil. However, coatings invariably have flaws (referred to as "holidays") which can act as sites for corrosion. Therefore, cathodic protection is applied to the pipe to prevent the flaws or holidays from becoming active corrosion sites. Cathodic protection involves the use of a small electric current to create a film of hydrogen gas at the holidays to insulate them from the soil.

Since a coated pipe line is usually more than 99% covered, the amount of current needed for cathodic protection of the remaining 1% or less is relatively small. However, when consideration is taken into account of the many miles of coated pipe which are under cathodic protection, the amount of power required to maintain the added protection has a significant impact on overall operating costs. The problem becomes exacerbated when hot spots develop on the pipe which require additional current to maintain the necessary pipe-to-soil potential for cathodic protection.

Another type of protection for pipes takes the form of sacrificial electrodes which are electrically connected to the pipe at intervals along the length thereof. The most usual sacrificial electrode in this respect is made up of magnesium in a suitable medium. Here again, holidays in a pipe result in an increased depletion of the sacrificial metal and the requirement of replacing the same at more frequent intervals than would otherwise be the case if the surface integrity of the pipe coating had not been disrupted.

THE PRIOR ART

It has long been known that protective coatings may be placed on electrically conductive surfaces using electrolytic processes for deposition of the protective agent but these processes have involved for the most part industrial procedures wherein the part to be coated is dipped into the resin solution for a relatively short interval of time. The part which is dipped into the coating composition is one electrode of the electrical current path while the opposite polarity electrode is immersed in the coating bath. Organic polymers are dispersed in water to provide the coating material. Passage of a direct current through the electrolytic system causes the resin ions to electrophoretically migrate toward the surface of the item to be coated where the resin reacts with ions evolved from the water, to produce an insoluble layer on the metal item. In the case of anionic resin materials wherein the structure to be coated is set up as the anode, hydrogen ions and oxygen are produced at the anode while hydroxide ions and hydrogen gas are formed at the cathode. Because the surface of the part to be coated serves as an anode, if the resin has carboxylate anions for example, the ions combine with the hydrogen ions generated at such electrode to thereby insolubilize the resin molecules and form a coating on the surface of the item dipped in the resin bath. The build up of polymer molecules on the surface of the metal item generally creates a relatively adherent, only slightly tacky film on the metal surface, but the resin must be thermally or chemically cured to cross-link the polymer. Solubilizers used as a part of the resin system remain in the bath.

Cathodic coating procedures have also been used to a certain extent, but their development has been hindered somewhat by the fact that cationic resins generally do not have quite the inherent throwing power or ability to effectively coat recessed areas as has been found to be the case with anionic resins which are not as adversely affected by Faraday cage electrical effects as is the case with cationic resins.

The prior patent art includes U.S. Pat. No. 3,199,585 of Aug. 10, 1965; U.S. Pat. No. 3,978,015; and U.S. Pat. No. 4,064,028 of Dec. 20, 1977. In the U.S. Pat. No. 3,199,585 patent of Cronberger, the patentee suggests electrodeposition of an anticorrosion agent on the casing of a well by filling the casing as well as an area surrounding the pipe with a resin composition and then impressing a direct current on such composition of a polarity to cause the resin to form a protective layer on the surface of the casing. Cronberger's process is in effect similar to conventional bath techniques in that the conductive member to be coated, i.e. the well casing is submerged in a bath of the resin material and the direct current then impressed on the coating composition and the well casing respectively. The U.S Pat. No. 3,978,015 and U.S. Pat. No. 4,064,028 patents also deal with emersion technology and describe various types of resins which are suitable for that purpose.

BRIEF SUMMARY OF THE INVENTION

The present process permits application of a protective coating to conductive portions of metallic structures buried in the ground such as fluid pipe lines or electrical conduits by the simple expedient of boring a hole in the ground to the level of the conductive portion of the pipe or other structure to be coated, directing a quantity of a dispersion of an ionic synthetic resin into the bore hole thus filling such hole to a predetermined level, and thereafter impressing a direct current on the metal structure and the resin composition respectively of a polarity such that resin ions electrophoretically migrate toward the surface of the structure contacted by the resin where they react with ions from the water solution to form an insoluble coating on the conductive surface of the pipe or other metal structure. A particularly important feature of the present invention is the fact that by impressing a direct current on the structure and the resin composition respectively of a voltage and a current and for an adequate period of time, gas evolved from electrolysis of the water pushes outwardly from the initial situs of the resin composition in contact with the conductive metallic structure displacing soil from the surface of the metallic structure thus allowing the resin composition to spread outwardly from the original area contacted thereby and thus progressively effect coverage of the metallic structure with the resin material over an area of the metallic structure of far greater extent than that of the original bore hole.

An especially important feature of the process is the fact that the method allows protection of buried pipes and the like even though such pipes have areas of conductive corrosion thereon which cannot be removed prior to treatment because of the buried nature of the structure. In the present process, the electrophoretic deposition of resin occurs even on the conductive corroded portions of the pipe or other metallic structure. The coating forms a strong adherent protective bond on the conductive corroded areas of the pipe which make up a bonded surface on the pipe whereas in the instance of flaky or bubble appearing corrosion sections, the resin penetrates these segments and deposits a film layer on the conductive surface of the pipe or other structure beneath the flaky or nodular areas of corrosion.

The process also lends itself to in situ coating of pipes by simply saturating the soil surrounding a part of the pipe to be coated. The actual coating is accomplished in full surrounding relationship to the pipe or other structure to the extent that the resin composition is in contacting relationship with conductive portions of the metal structure to be protected.

DETAILED DESCRIPTION OF THE INVENTION

Figure 1:
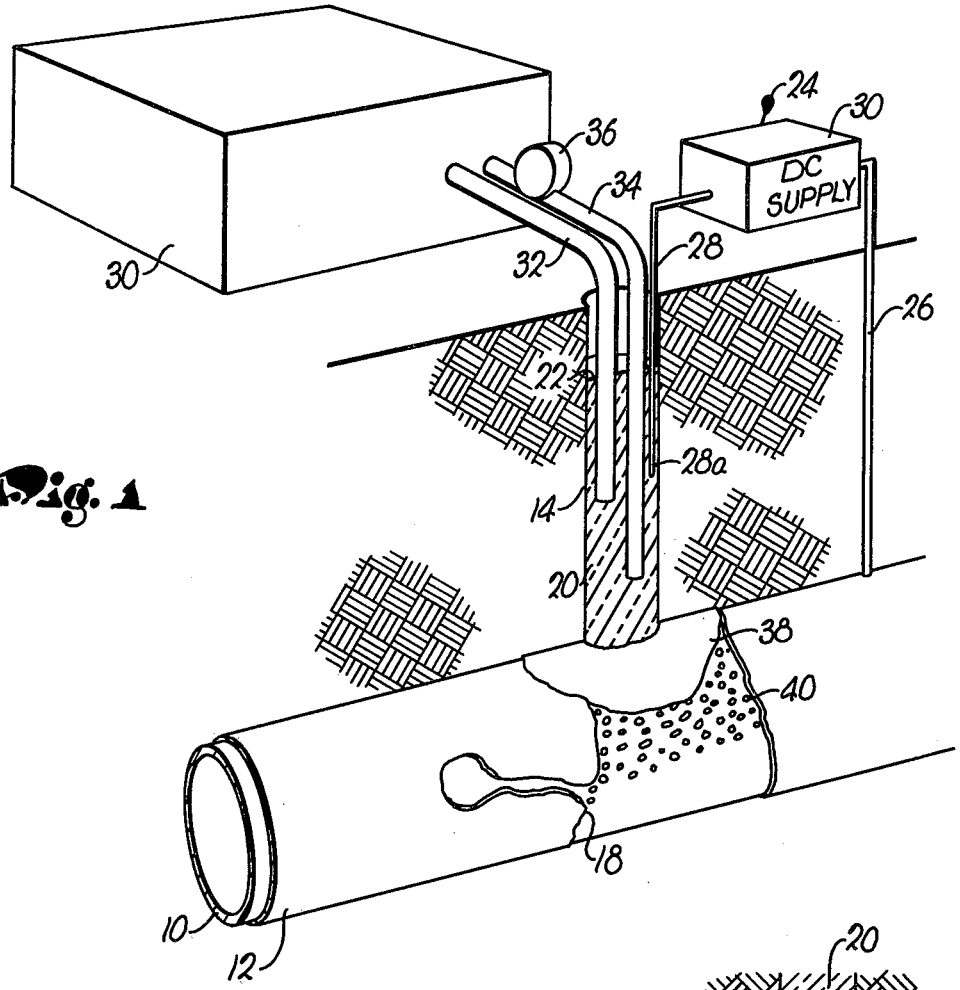
Figure 2:
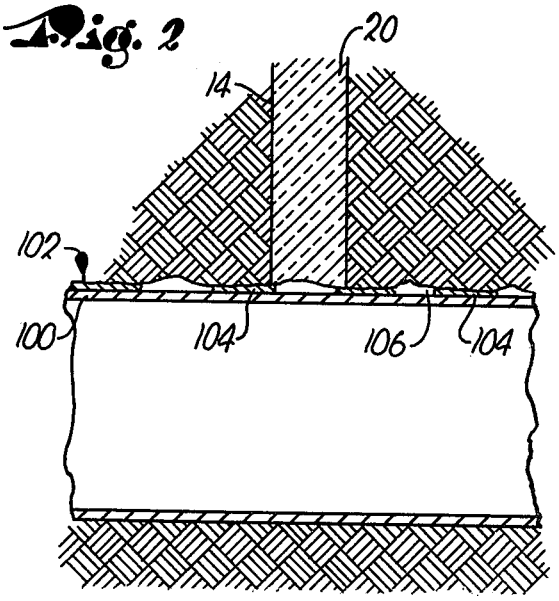
Figure 3:
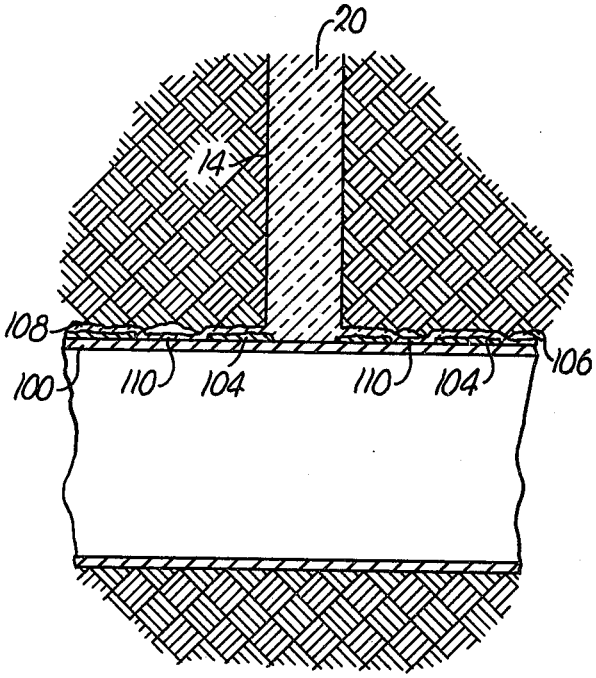

In the drawing:

FIG. 1 is a diagrammatic, partially cross-sectional, fragmentary view showing how the process of this invention may be advantageously used to provide a protective coating over a buried pipe having holidays or flaws in the original protective coating thereon;

FIG. 2 is an enlarged fragmentary schematic representation illustrating use of the process to coat a pipe which has corroded areas thereon and in this instance showing the nature of the layer of corrosion at the commencement of the in situ protection process; and FIG. 3 is a cross-sectional, essentially schematic showing similar to the showing of FIG. 2, but in this instance illustrating the way in which the method allows deposition of a protective resin layer on the pipe in firmly adhering relationship thereto over areas of conductive corrosion such as oxidized sections which firmly adhere to the pipe, as well as beneath bubbled or flaky areas of corrosion which project away and are spaced from the firmly adherent surface layers of the pipe or other metallic structure.

Directing attention initially to FIG. 1 of the drawing, a pipe 10 is illustrated as being exemplary of a metal structure buried in the ground where conductive areas thereof may be advantageously recoated with a resin material while buried in the ground. Thus, pipe 10 in this instance is shown as having a protective layer 12 thereover which may be in the form of a resin coating applied to pipe 10 prior to burying of the latter in the ground. Pipe 10 for example may be of the type conventionally used to transport fluids such as natural gas or gasoline over long distances and typically have a diameter of from two to four feet. However, it is to be understood that the process of this invention has application for any size of pipe or the like ranging down to electrical utility conduits which may be as small as two inches or less.

A 6 inch to 8 inch bore hole 14 is drilled in the ground using a conventional power-operated auger or the like, to the level of the pipe 10 in direct communication with a surface portion thereof which is conductive, either by virtue of the fact the pipe is bare, or at the situs of a holiday 18 therein. It is to be appreciated in this respect that the holiday 18 of a pipe to be recoated will be of appreciable area in order to have been detectable by conventional electrical survey techniques commonly practiced in the art. Although the bore hole 14 may be cased with pipe or the like if necessary to contain the resin composition to be directed thereinto if the soil is very porous, this may be done although in most instances it is adequate to simply rely upon the wall of the bore hole 14 to serve as a containing medium for the resin composition.

Next, a water dispersion of an ionic resin composition is introduced into the bore hole 14 to form a reservoir 20 of such composition filling the bore hole 14 to a predetermined level (indicated schematically by the numeral 22 in the drawing). The ionic resin composition may be formulated using various types of resin systems, either of the cationic or anionic type. Exemplary resins are of the electrophoretically depositable alkyds, polyesters, acrylics, epoxy esters or similar materials. These may be generically classified as solubilized acidic resins, e.g. RCOOH or solubilized alkaline resins, i.e. $RNH_2$. A suitable cationic resin for practice of the process described herein is Pittsburgh Plate Glass Company's Powerprime 500 as described in U.S. Pat. No. 3,984,299 and which comprises a hydroxyl-containing adduct such as the reaction product of a primary or secondary amine and a polyepoxide wherein the adduct is solubilized to provide cationic groups, and combined with a blocked organic polyisocyanate. An especially preferred resin is an anionic composition manufactured and sold by Pittsburgh Plate Glass Company which is distributed under the designation Powerprime 100. This resin is disclosed in U.S. Pat. No. 3,537,969 along with other equivalent resins and may be generally described as a partially esterified and neutralized adduct of a drying oil fatty acid and an anhydride of an ethylenically unsaturated dicarboxylic acid, formed by reacting the adduct with a polyol in the presence of water and an amine. The preferred polyols are methylated phenols and resinous polyols, reacted with maleic anyhydride adducts of drying oils or fatty acid esters of resinous polyols. A resin of this type is especially useful in the present process because of the fact that the polymer is unsaturated and therefore undergoes cross-linking and self-curing with time developing into a stable coating which is highly resistant to degradation or dislodgment from the substrate on which it is deposited.

Although the amount of resin in the water may be varied depending upon the results sought, typical formulations involve the use of compositions initially containing from about 10% to 20% solids and respectively 90% to 80% liquid.

A DC power supply (typically in the range of 50 to 200 V with the amperage draw being dependent on the area subject to being cooled) must be provided which has been broadly numerated 24 and for schematic purposes only is illustrated as having a path 26 for electrical current connected directly to the metal pipe 10 as well as a path 28 leading to the electrode in reservoir 20 of the resin composition. A metal element 28*a* immersed in the coating composition may serve as an electrode or if a metal casing for the bore hole is used, that pipe may be used as an electrode. In one instance, path 26 may simply be the cathodic protection leads which are generally thermite welded to the pipe at spaced intervals along the length thereof, or a metal stake can be driven into the ground until it contacts the pipe whereupon an electrical lead can be connected to the stake above ground level. It is to be understood that the direct current source 30 of supply 24 may take any convenient form which in many instances can be in the nature of the power pack used to supply current to welding equipment that is conventionally available along pipe lines as a part of the owner's maintenance gear.

Again for illustrative purposes only, a storage container 30 is shown for an added supply of the resin composition and which is connected to the reservoir 20 through the means of supply and return pipes 32 and 34. A pump is schematically indicated in line 34 and designated by the numeral 36. Desirably, the level of resin in the coating composition contacting a conductive surface of the pipe or other structure should be maintained at about 10% or above.

As previously explained, after drilling of bore hole 14 and introduction of the resin composition thereinto so that such resin material is in direct contact with either a conductive portion of the pipe or other structure or the bare metal of pipe 10, pipes 32 and 34 are introduced into the coating composition reservoir 20 and pump 36 activated to recirculate the resin composition from the storage container 30 to the bore hole 14 and back. The current source 30 is activated to impress a direct current on the pipe 10 and the reservoir 20 of resin material with the polarity and voltage and/or amperage of such electrical current being a function of the type of resin employed. For example, in the case of the utilization of an anionic resin such as Pittsburgh Plate Glass Powerprime 100, the pipe 10 serves as the anode of the system whereas the electrode 28*a* immersed in the resin composition defining reservoir 20 and the path 28 is the cathode.

The process may be carried out under conditions such that the DC supply 24 operates at a constant voltage, or in the alternative, the method may be practiced with equal facility utilizing a constant amperage source. In any event though, the direct current source must be capable of impressing direct current on the system adequate to cause the resin ions in the composition of reservoir 20 to electrophoretically migrate toward the surface of the conductive metal structure exposed to the resin material. The optimum voltage and amperage levels will vary depending on the type of resin employed. In the case of an anionic resin composition as described in connection with the preferred embodiment of this invention, the resin ions react at the surface of the metal structure to be coated with hydrogen ions resulting from electrolysis of the water in the resin composition to insolubilize the resin at the surface of the metal structure and thereby effect laying down of a uniform coating of the resin on the pipe structure. The coating continues to increase in thickness until a layer of the order of about 1 mil dry film thickness is layed down. Generally this layer will vary from about 0.7 to about 1.2 mils as a dry film.

As the film builds up on the area of the structure being coated which is directly exposed to the resin composition, that area becomes electrically insulated and film deposition decreases until it virtually ceases. At that point, however, gas evolution at the conductive surface of the structure (oxygen in the case of an anionic resin where the metal structure is the anode, or hydrogen in the instance where a cationic resin is employed and the metal structure being coated is the cathode) and a certain proportion of this gas tends to move outwardly along the conductive surface of the metal structure before ultimately dispersing into the soil or excaping through the bore hole. The gas displaces the soil immediately adjacent the conductive surface of the metal structure being coated thus allowing the resin composition to progressively flow outwardly in enveloping relationship to the metal structure beyond the confines of the original diameter of the bore hole 14. As the resin comes into contact with additional areas of conductive portions of the metal structure and sees the difference in polarity of the direct current impressed on the system, additional resin ions are electrophoretically deposited on new conductive surface areas of the metal structure to build up a layer of protective coating thereon. This process continues with a progressively increasing conductive area of the metal structure being coated with the resin material so long as the direct current is impressed on the resin composition reservoir 20 and the metal structure such as pipe 10.

In FIG. 1, for purposes of illustration, a conductive area of the pipe designated 38 is shown as having been coated with the resin material beyond the confines of the diameter of the bore hole 14 while additional gas generated by the process is indicated schematically by the bubbles 40. This gas continuing to move progressively outwardly from the central bore hole 14 displaces soil from direct contact with the conductive metal structure or other substrate to be coated and allows the resin composition to move further and further away from the central source of supply thereof. The extent to which this progressive increase in coating may occur is primarily a function of the contiguous conductive area of the pipe, the levels of current and voltage applied to the substrate to be coated, the availability of resin ions to electrophoretically migrate to the metal surface, and the time during which the current is impressed on the system. Furthermore, by recirculating the resin back to the storage container 30 as schematically illustrated in FIG. 1, a fresh supply of resin in ionic form is constantly available for most effective deposit of resin on the pipe or other structure.

It is also to be recognized that by virtue of the nature of the electrophoretic deposition of resin on conductive areas of the pipe 10 or other structure, the resin molecules which are attracted to the surface of the pipe or other member are very closely packed together and virtually all water is excluded from the resin layer (probably no more than about 2% residual water by weight of the total resin layer).

A particularly important feature of the present process is shown schematically in FIGS. 2 and 3. In these diagrammatic representations, the pipe 100 has a layer of conductive corrosion representing an accumulation of deposits thereon over the period of time in which the pipe 100 is buried in the ground. This conductive corrosion layer (e.g. oxidation) broadly designated 102 may typically include segments 104 which closely adhere and are strongly bonded to the outer surface of the pipe 100 or other similar structure, as well as other sections 106 which are not firmly attached to the pipe and may take the form of flakes, bubbles or nodules which project away and are in effect spaced from the outer surface of the pipe such that there is a void area between the outer conductive surface of the pipe and the inner face of the corroded sections.

It has been found that by using the in situ coating process of this invention for depositing a layer of a synthetic resin on a pipe or the like buried beneath the ground, the electrophoretic deposition of the resin on the pipe causes the resin to be laid down in a closely adhering bonded coating on conductive areas such as 104 which are firmly affixed to the pipe surface 10, but in the instances where the electrodeposition occurs at flaked, bubbled or less firmly adherent sections 106, the resin ions penetrate these sections and bond to the firmly adherent conductive areas of the pipe therebeneath. This is shown diagrammatically in FIG. 3 wherein the resin layer 108 is illustrated as being deposited on the firmly adherent section 104 of the corrosion whereas layer 110 is indicated to have penetrated the flaky, bubbled or other non-adherent corrosion layer and deposited directly on the conductive area of pipe or firmly adherent corrosion area therebeneath.

The unique functionality of the in situ coating process described herein has been demonstrated by the following example:

EXAMPLE I

An anionic resin composition was prepared containing 10% and 90% water. The resin was Powerprime 100 furnished by PPG already reduced for application. The resin solution was agitated with an electrical stirrer for approximately one hour prior to conduct of the tests. Western Bentonite clay was mixed with tap water to make a wet hard-pack mud which was packed into a nylon mesh tube approximately 3 inches in diameter and 7 inches long. A solid steel rod (1¼ inch diameter ×6 inches long) with a partially oxidized surface was centered longitudinally in the clay with only one end exposed. A ¼ inch hole was made midway through the side of the clay tube to the surface of the steel rod.

The clay tube containing the steel rod was placed in a glass reservoir containing the resin solution and the exposed end of the steel rod was connected to the positive side of a DC power supply. A carbon rod was hung in the resin solution reservoir and connected to the negative side of the power supply. A potential of 150 volts was applied for 10 seconds and then the voltage was dropped to 100 volts for 15 minutes. Amperage dropped from a momentary high of approximately 5 amps to a level of approximately 0.15 amps indicating deposition of the insulating film. On extraction from the clay, the steel rod was well coated circumferentially and longitudinally with the black pigmented resin and the film showed good adhesion and electrical resistivity properties.

In order to illustrate the in situ coating of a pipe under conditions where the resin composition is provided in surrounding relationship to the item to be protective coated by saturating the soil surrounding the pipe or other structure with the resin material, the following test was conducted:

EXAMPLE II

The resin which was electrodeposited was B. F. Goodrich Carboset 514H. This material was solubilized with ammonium hydroxide in distilled water to produce a solution containing 20% resin and providing a pH of 8.0. The solution was mixed with soil and deposited on a partially oxidized steel plate (6 square inch area) at a voltage of 100 V for a period of 3 minutes. The coating resulted in an immediate significant reduction (from 8.5 ma to 7.2 ma) in current demand when placed in a magnesium rod/steel plate/soil electrolyte system. The current demand on the anode continued to decrease over the next several days indicating further development of insulating film properties.

Another test confirming the utility of the present process for in situ coating of buried objects such as pipes or the like was as follows:

EXAMPLE III

A quantity of Carboset 514H resin (B. F. Goodrich product) was heated to 65° C., solubilized with ammonium hydroxide, and diluted to approximately 20% solids. This solution was poured into a cavity created by removing a 1½ inch ×⅛ inch rusted steel plate embedded in soil contained in a beaker. The steel plate was then replaced in the resin-saturated soil and made the anode with respect to a DC power supply. Two pieces of 12 gauge steel wire were made the cathode. A potential of 100 v was applied to the system for 3 minutes during which the current dropped from 1.5A to 0.5A indicating that an insulating film was forming on the steel plate.

Prior to the test, the steel plate was used as the cathode in the system which was being cathodically protected with a magnesium anode. The cathodic protection current in this "before" condition was 8.5 ma. Immediately after deposition of the resin, the current demand for cathodic protection dropped to 7.2 ma. Thus the deposition of the resin reduced the demand on the magnesium for cathodic protection by about 15%. After sitting overnight, the current demand dropped to about 3 ma indicating that the steel plate had become even more insulated from the environment, and current demand for cathodic protection was reduced by 65%.

It can now be seen that the process described herein may be employed for coating bare metal such as uncoated pipes or recoating imperfections or holidays in pipe line coverings on an as-needed basis. Furthermore, electrodeposition of resins on metal products may be used with equal facility to protectively coat hard to get at places of metal objects buried underground such as angles, intricate connections and complex joints. By virtue of the fact that the metal carries a charge, the resin in solution which carries an opposite charge is attracted to the metal where the opposing charges become neutralized and the resin is deposited in a more uniform manner than would otherwise be the case notwithstanding the fact that the object being coated is buried beneath the ground. Thus, bare metal pipes or coatings damaged by faulty laying techniques can be repaired, electricity consumption for cathodic protection is substantially diminished and longer life for anode beds (either impressed current or sacrificial magnesium) can be obtained.

I claim:

1. A method of coating electrically conductive structures buried in the ground comprising the steps of:

providing a passageway extending from the surface of the ground to a level where a portion only of the conductive structure is brought into direct communication with the passageway while the remainder of the structure adjacent the passageway remains buried in the ground and in intimate contact with the surrounding soil;

introducing a quantity of a water dispersion of an ionic organic resin composition into the passageway to form a reservoir thereof in direct contact with said portion of the structure which communicates with the passageway;

establishing a path for flow of electrical current to the reservoir of said resin composition and to said conductive structure respectively; and impressing direct current on said structure and the resin composition in said reservoir along the electrical paths therefor of a polarity to cause the resin ions in the compositions to migrate electrophoretically to the conductive structure and to react with ions generated from the water at the surface of the structure to insolubilize the resin and effect a coating thereof on the conductive portion of such structure contacted by the resin composition, said direct current being impressed on the structure and said reservoir of a voltage and amperage level and for a time period to cause sufficient gas to be evolved from the water dispersion of said resin composition at the conductive surface of the structure as the resin is deposited on and coats said portion of the conductive structure, such that the gas assists in displacement of enough soil surrounding the structure to allow the resin composition to contact and coat conductive portions of the structure remote from the passageway and not originally contacted thereby thus increasing the area of the structure coated with said resin.

2. A method as set forth in claim 1 wherein is included the step of saturating soil surrounding the portion of the structure communicating with said passageway to enhance the extent of the coating of the structure with said resin.

3. A method as set forth in claim 1 wherein is including the steps of forming said reservoir of resin composition by boring a hole in the ground to the level of the conductive structure to be coated, and then filling such bore hole with said resin composition to a predetermined depth.

4. A method as set forth in claim 3 wherein is included the step of providing a supply of said resin composition and recirculating the resin composition from said reservoir thereof to said supply and back to minimize decrease of the resin level in said composition contained in the bore hole.

5. A method as set forth in claim 1 wherein said resin is an anionic type material and the direct current is impressed on the structure and said reservoir of resin composition in a manner causing the structure to be the anodic electrode and the reservoir of resin to be the cathodic electrode of the electrolytic system.

6. A method as set forth in claim 1 wherein said resin is an epoxy ester.

7. A method as set forth in claim 6 wherein said resin has been solubilized by reaction thereof with an amine.

8. A method as set forth in claim 6 wherein said resin is of the unsaturated type capable of undergoing cross-linking and self-curing with passage of time.

9. A method of coating an electrically conductive structure buried in the ground and which has adjacent areas of corrosion on the surface thereof, certain of said areas being of electrically conductive properties and tightly adhering to the structure, and other of the areas being of generally not tightly adhering relationship to the structure and essentially of non-conductive characteristics, said method comprising the steps of:

contacting at least a portion of both of said areas of the structure below ground level with a common reservoir of a water dispersion of an ionic organic resin composition while remaining adjacent parts of the structure remain buried in the ground and an intimate contact with the surrounding soil; and impressing direct current on said structure and the reservoir of said resin composition of a polarity and at a voltage and amperage and for a time period to cause resin ions to migrate electrophoretically to the tightly adhering conductive areas in coating relationship thereto and to penetrate the not tightly adhering areas and to coat the conductive structure therebeneath.

10. A method as set forth in claim 9 wherein the direct current is impressed on the conductive structure and said resin composition contacting the conductive structure for a time period such that gas evolved from the water dispersion of said resin composition at the surface of the structure as the resin is deposited on and coats the structure, displaces soil surrounding the structure thereby allowing the resin composition to contact conductive portions of the structure not originally contacted thereby thus increasing the conductive area of the structure coated with said resin.

* * * * *